US011506445B2

(12) United States Patent
Lubben et al.

(10) Patent No.: US 11,506,445 B2
(45) Date of Patent: Nov. 22, 2022

(54) REFRIGERATED DELIVERY RECEIVING FURNITURE SYSTEM

(71) Applicants: Vince Lubben, Sioux Falls, SD (US); Owen Lubben, Sioux Falls, SD (US)

(72) Inventors: Vince Lubben, Sioux Falls, SD (US); Owen Lubben, Sioux Falls, SD (US)

( * ) Notice: Subject to any disclaimer, the term of this patent is extended or adjusted under 35 U.S.C. 154(b) by 211 days.

(21) Appl. No.: 16/445,422

(22) Filed: Jun. 19, 2019

(65) Prior Publication Data

US 2020/0400368 A1 Dec. 24, 2020

(51) Int. Cl.

| | |
|---|---|
| ***F25D 23/12*** | (2006.01) |
| ***A47C 17/24*** | (2006.01) |
| ***F25D 23/02*** | (2006.01) |
| ***F25D 23/10*** | (2006.01) |
| ***A47C 17/86*** | (2006.01) |
| ***F25D 27/00*** | (2006.01) |
| ***F25D 29/00*** | (2006.01) |
| ***A47C 17/00*** | (2006.01) |
| ***A47C 7/62*** | (2006.01) |

(52) U.S. Cl.

CPC ..... *F25D 23/12* (2013.01); *A47C 17/00* (2013.01); *A47C 17/24* (2013.01); *A47C 17/86* (2013.01); *F25D 23/028* (2013.01); *F25D 23/10* (2013.01); *F25D 27/005* (2013.01); *F25D 29/00* (2013.01); *F25D 29/005* (2013.01); *F25D 29/006* (2013.01); *A47C 7/628* (2018.08); *F25D 2300/00* (2013.01); *F25D 2325/00* (2013.01); *F25D 2400/36* (2013.01); *F25D 2700/04* (2013.01)

(58) Field of Classification Search

CPC ..... F25D 23/12; F25D 29/006; F25D 29/005; F25D 29/00; F25D 27/005; F25D 23/028; F25D 23/10; F25D 2700/04; F25D 2400/36; F25D 2325/00; F25D 2300/00; A47C 17/24; A47C 17/86; A47C 17/00; A47C 7/628

See application file for complete search history.

(56) References Cited

U.S. PATENT DOCUMENTS 3,605,431 A 9/1971 Carson
4,024,729 A * 5/1977 Abate, Sr. ..... A47G 29/28 62/263

(Continued)

FOREIGN PATENT DOCUMENTS

CA 2264296 C * 4/2005 ..... A47G 29/141
KR 1020160060370 11/2017

*Primary Examiner* — Ljiljana V. Ciric

(57) ABSTRACT

A refrigerated delivery receiving furniture system includes a piece of furniture having a frame and a seat coupled to the frame. A container having an interior space is coupled to the piece of furniture. A lid is movably coupled to the container to selectively cover the interior space. The lid is movable between an open position and a closed position. A refrigeration assembly is coupled to the container includes a compressor such that the refrigeration assembly cools the interior space. A processor is coupled to the container and operationally coupled to said compressor. An interior camera is positioned within the interior space and operationally coupled to said processor. A panel is positionable within a selectable aligned pair of vertically oriented slots in the interior space to divide the interior space into compartments within said container.

18 Claims, 6 Drawing Sheets

(56) References Cited

U.S. PATENT DOCUMENTS 5,774,053 A 6/1998 Porter
10,039,401 B1 * 8/2018 Romanucci ..... A47C 7/628
10,222,119 B2 * 3/2019 Rezayat ..... F25D 29/00
10,638,848 B1 * 5/2020 Wesley ..... E05B 49/00
10,729,265 B2 * 8/2020 High ..... A47G 29/141
10,772,450 B2 * 9/2020 Waisanen ..... G08B 13/19684
10,820,733 B2 * 11/2020 Kaiserman ..... A47G 29/20
10,835,046 B2 * 11/2020 Chasnis, II ..... A47G 29/141
10,881,235 B1 * 1/2021 Vasquez ..... A47C 7/628
10,883,754 B2 * 1/2021 Dade ..... F25D 25/02
10,976,092 B2 * 4/2021 Dade ..... A47G 29/141
11,026,532 B2 * 6/2021 Jessie ..... F25D 29/00
11,064,832 B1 * 7/2021 Goldstein ..... A47C 7/628
11,131,498 B2 * 9/2021 Marutani ..... F25D 29/006
11,166,580 B2 * 11/2021 Waisanen ..... E05F 15/616
11,215,392 B2 * 1/2022 Lim ..... F25D 29/00
11,274,876 B2 * 3/2022 Hall ..... H05B 6/68
11,343,418 B2 * 5/2022 Carlotto ..... G06F 16/51
2005/0178135 A1 * 8/2005 Schanin ..... G07F 9/105
62/228.1
2006/0123806 A1 * 6/2006 Vassilev ..... G07F 9/026
62/129
2007/0236357 A1 * 10/2007 Glielmo ..... G06Q 10/087
340/585
2008/0109109 A1 * 5/2008 Schanin ..... G07F 9/105
700/231
2009/0282859 A1 * 11/2009 Glielmo ..... G06Q 10/087
62/440
2010/0258643 A1 * 10/2010 Glielmo ..... G06Q 10/08
236/51
2012/0210743 A1 * 8/2012 Johnson ..... F25D 23/02
62/239
2014/0013666 A1 * 1/2014 Johnson ..... E05F 15/77
49/25
2016/0125466 A1 * 5/2016 Kulkarni ..... G06F 3/04883
705/14.58
2016/0358508 A1 * 12/2016 Cheatham, III ..... G06V 40/172
2017/0053516 A1 * 2/2017 Wu ..... H04L 12/2829
2017/0146287 A1 * 5/2017 Rezayat ..... G08B 21/182
2017/0215620 A1 * 8/2017 Dade ..... F25D 13/04
2017/0215643 A1 8/2017 Beach
2017/0292760 A1 * 10/2017 Dade ..... A47G 29/30
2017/0292761 A1 * 10/2017 Dade ..... F25D 13/04
2017/0299249 A1 * 10/2017 Dade ..... F25B 29/003
2017/0343247 A1 11/2017 Ahmad
2018/0125278 A1 5/2018 Jiang
2018/0220827 A1 * 8/2018 Romanucci ..... G06Q 10/0833
2018/0242768 A1 8/2018 Lewis
2018/0285653 A1 * 10/2018 Li ..... G08B 13/19645
2018/0310714 A1 * 11/2018 Becker ..... A47C 11/00
2019/0003733 A1 * 1/2019 Ratchford ..... G07C 9/00563
2019/0130348 A1 * 5/2019 Mellado ..... G07C 9/00912
2019/0231106 A1 * 8/2019 Kaiserman ..... F25D 13/04
2019/0239650 A1 * 8/2019 Nelson ..... E05B 65/52
2019/0282015 A1 * 9/2019 High ..... A47G 29/141
2019/0316835 A1 * 10/2019 Marutani ..... A47L 9/2805
2019/0362579 A1 * 11/2019 Phillips ..... F25D 29/006
2019/0387910 A1 * 12/2019 Stoich ..... G07C 9/33
2020/0116414 A1 * 4/2020 Dade ..... F25D 13/04
2020/0121087 A1 * 4/2020 Kilburn ..... A47C 11/00
2020/0121088 A1 * 4/2020 Chasnis, II ..... A47G 29/141
2020/0128991 A1 * 4/2020 Jessie ..... F25D 29/00
2020/0146454 A1 * 5/2020 Wesley ..... A47C 7/628
2020/0158359 A1 * 5/2020 Ratchford ..... F24F 11/0008
2020/0163480 A1 * 5/2020 Waisanen ..... G08B 13/196
2020/0323376 A1 * 10/2020 Waisanen ..... A47C 11/00
2020/0397172 A1 * 12/2020 Kennett ..... E05B 65/52
2020/0400368 A1 * 12/2020 Lubben ..... F25D 23/10
2021/0177150 A1 * 6/2021 Liu ..... A47C 5/02
2021/0244191 A1 * 8/2021 Vasquez ..... A47C 7/628
2021/0315404 A9 * 10/2021 Waisanen ..... A47C 7/628
2022/0011042 A1 * 1/2022 Cosgrove ..... G06Q 20/203
2022/0163255 A1 * 5/2022 Hall ..... H05B 6/68

* cited by examiner

REFRIGERATED DELIVERY RECEIVING FURNITURE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to furniture and storage device and more particularly pertains to a new furniture and storage device for discretely securing refrigerated items outside a structure such as a dwelling until the items can be brought into and stored within the structure.

(2) Description of Related Art Including Information Disclosed Under 37 CFR 1.97 and 1.98

The prior art relates to furniture and storage devices.

BRIEF SUMMARY OF THE INVENTION

An embodiment of the disclosure meets the needs presented above by generally comprising a piece of furniture having a frame and a seat coupled to the frame. A container having an interior space is coupled to the piece of furniture. A lid is movably coupled to the container to selectively cover the interior space. The lid is movable between an open position and a closed position. A refrigeration is coupled to the container includes a compressor such that the refrigeration assembly cools the interior space.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
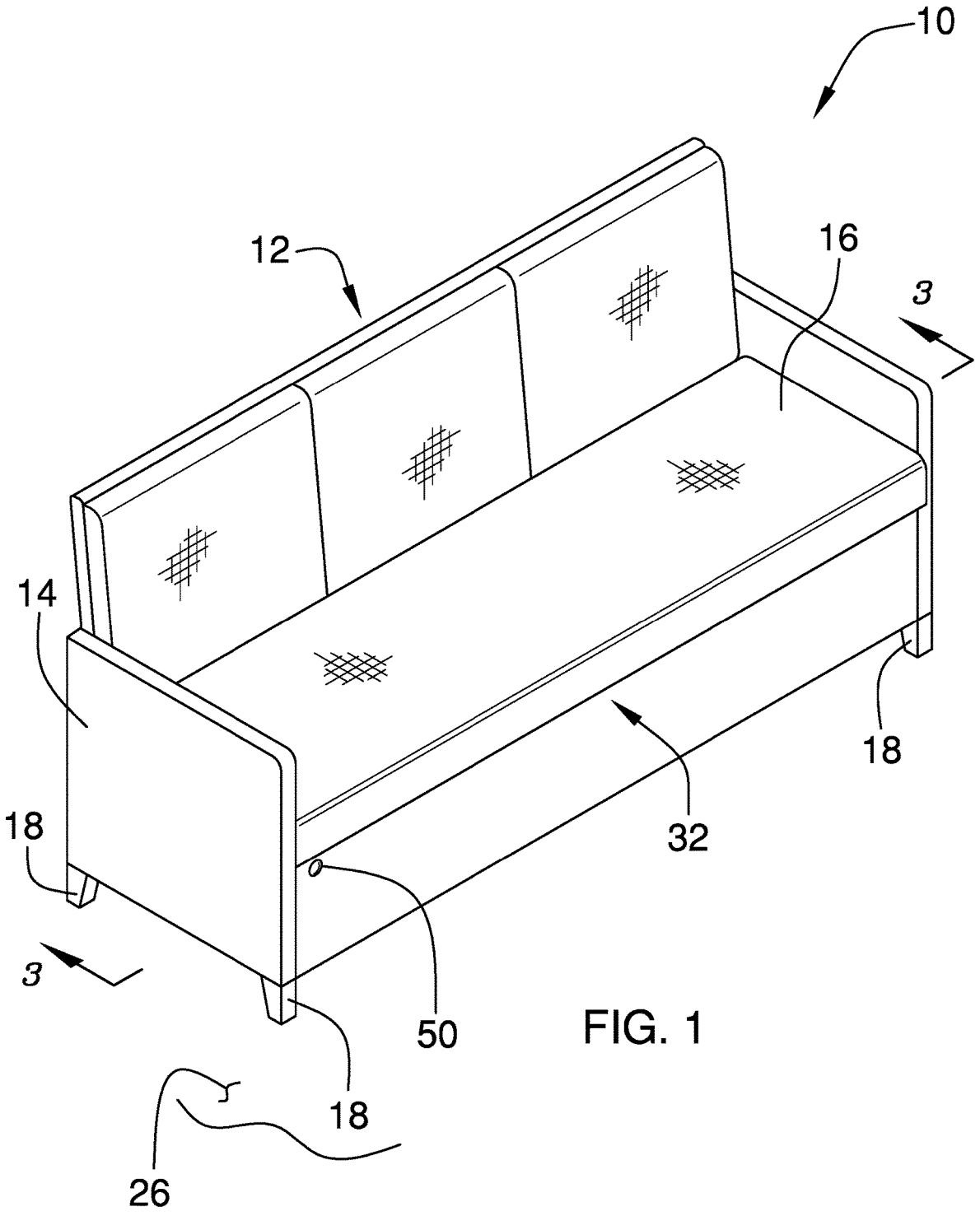
FIG. 1 is a top front side perspective view of a refrigerated delivery receiving furniture system according to an embodiment of the disclosure.
Figure 2:
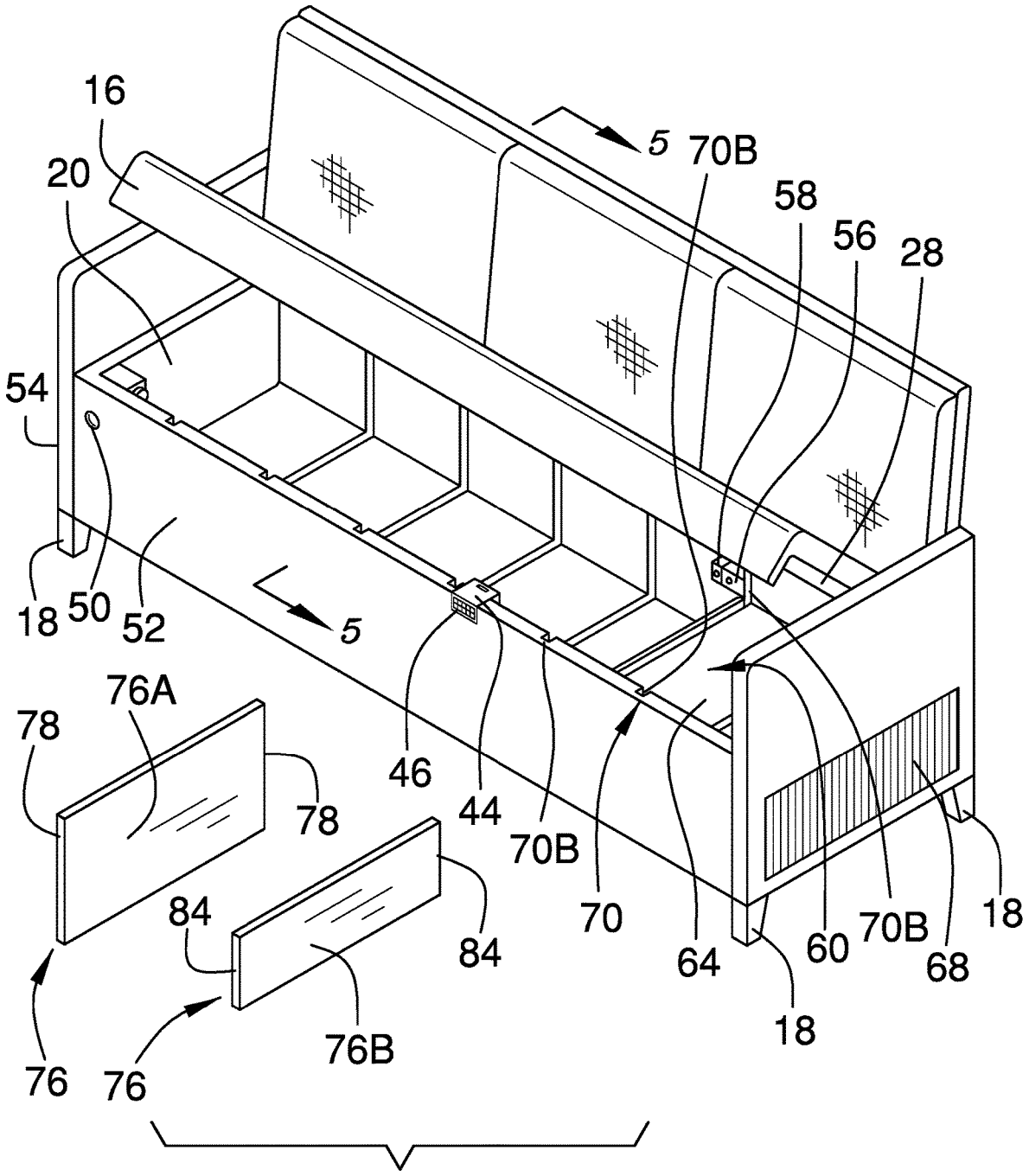
FIG. 2 is a top front side perspective view of an embodiment of the disclosure.
Figure 3:
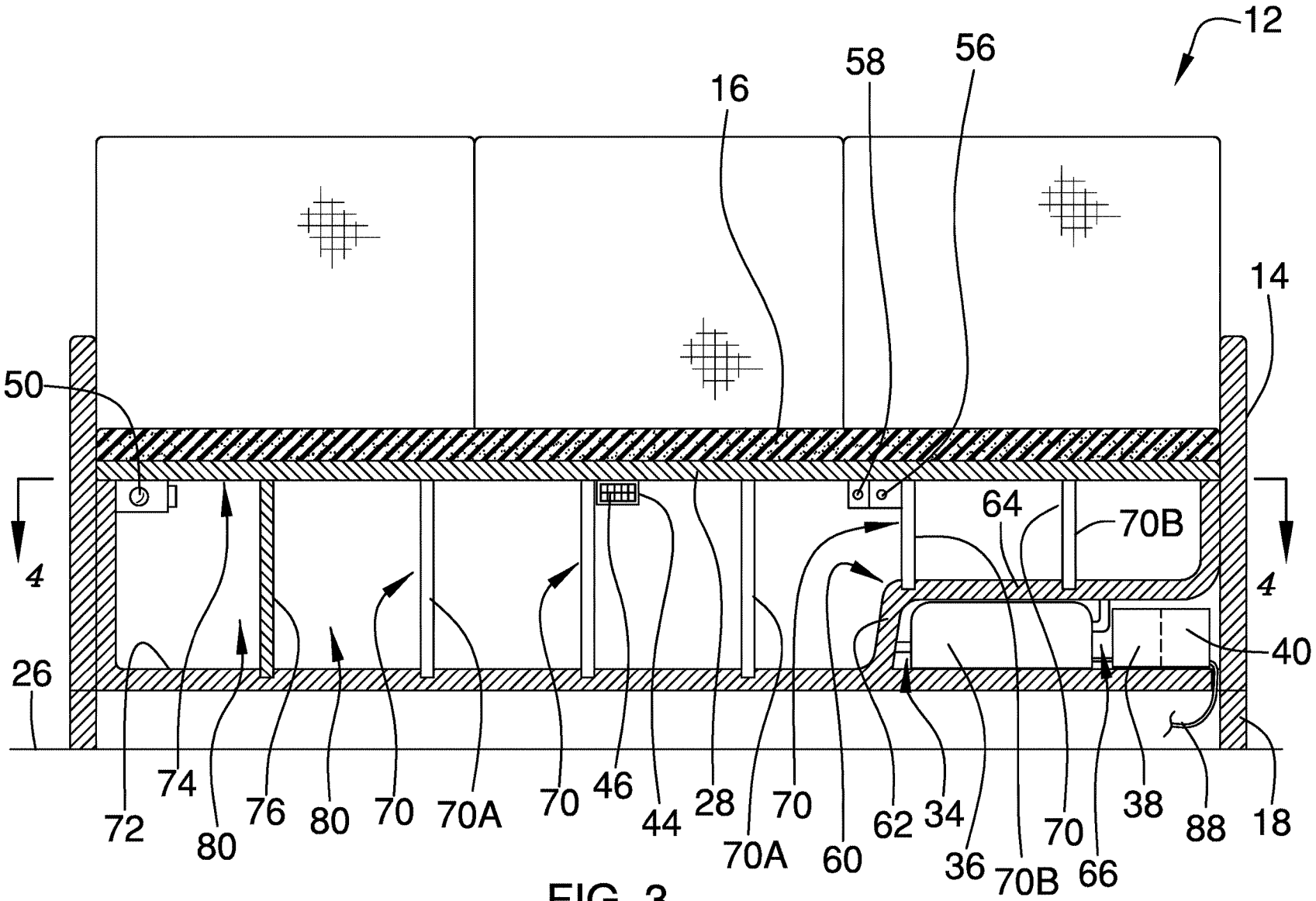
FIG. 3 is a cross-sectional view of an embodiment of the disclosure taken along line 3-3 of FIG. 1.
Figure 4:
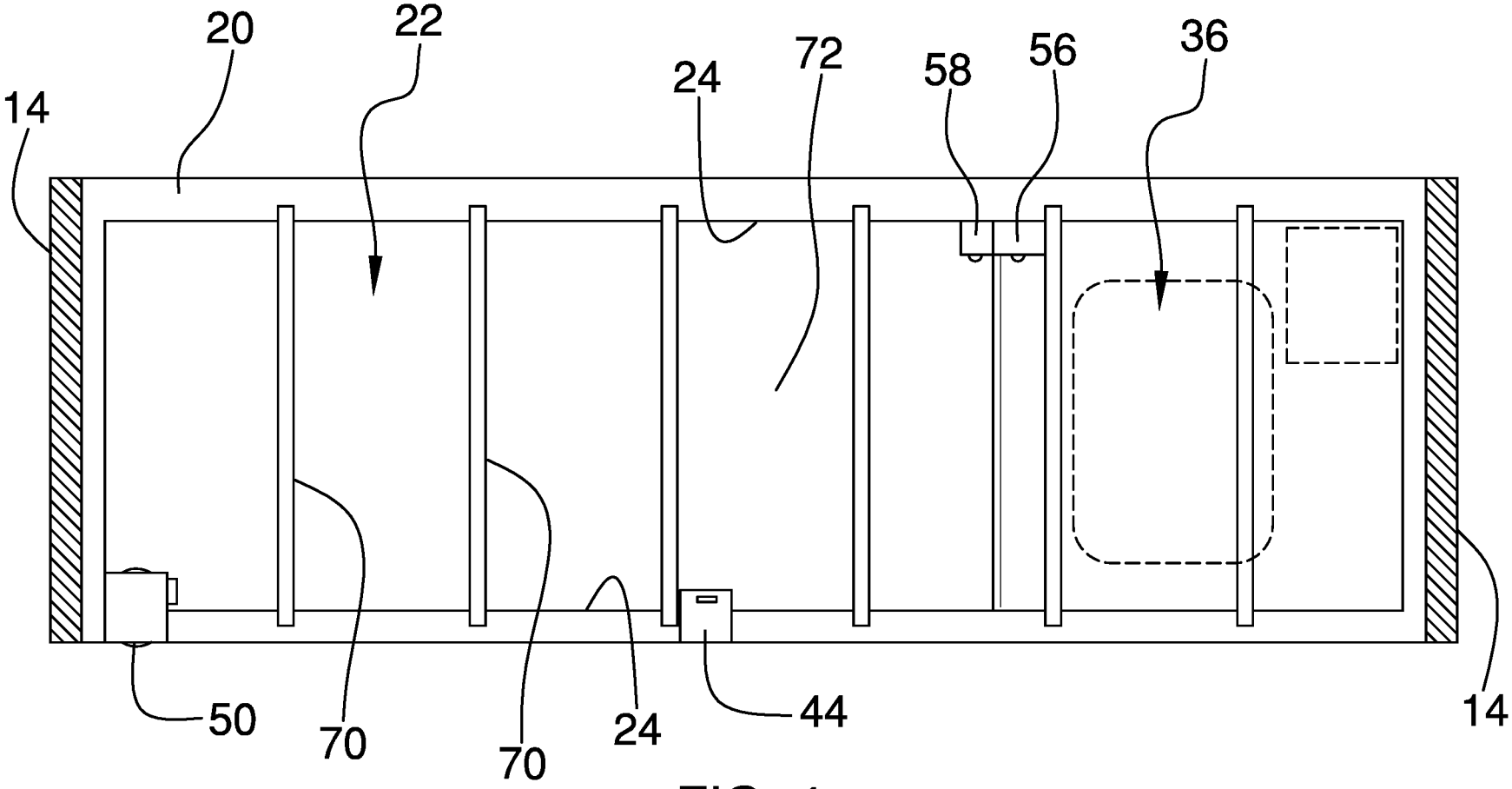
FIG. 4 is a cross-sectional view of an embodiment of the disclosure taken along line 4-4 of FIG. 3.
Figure 5:
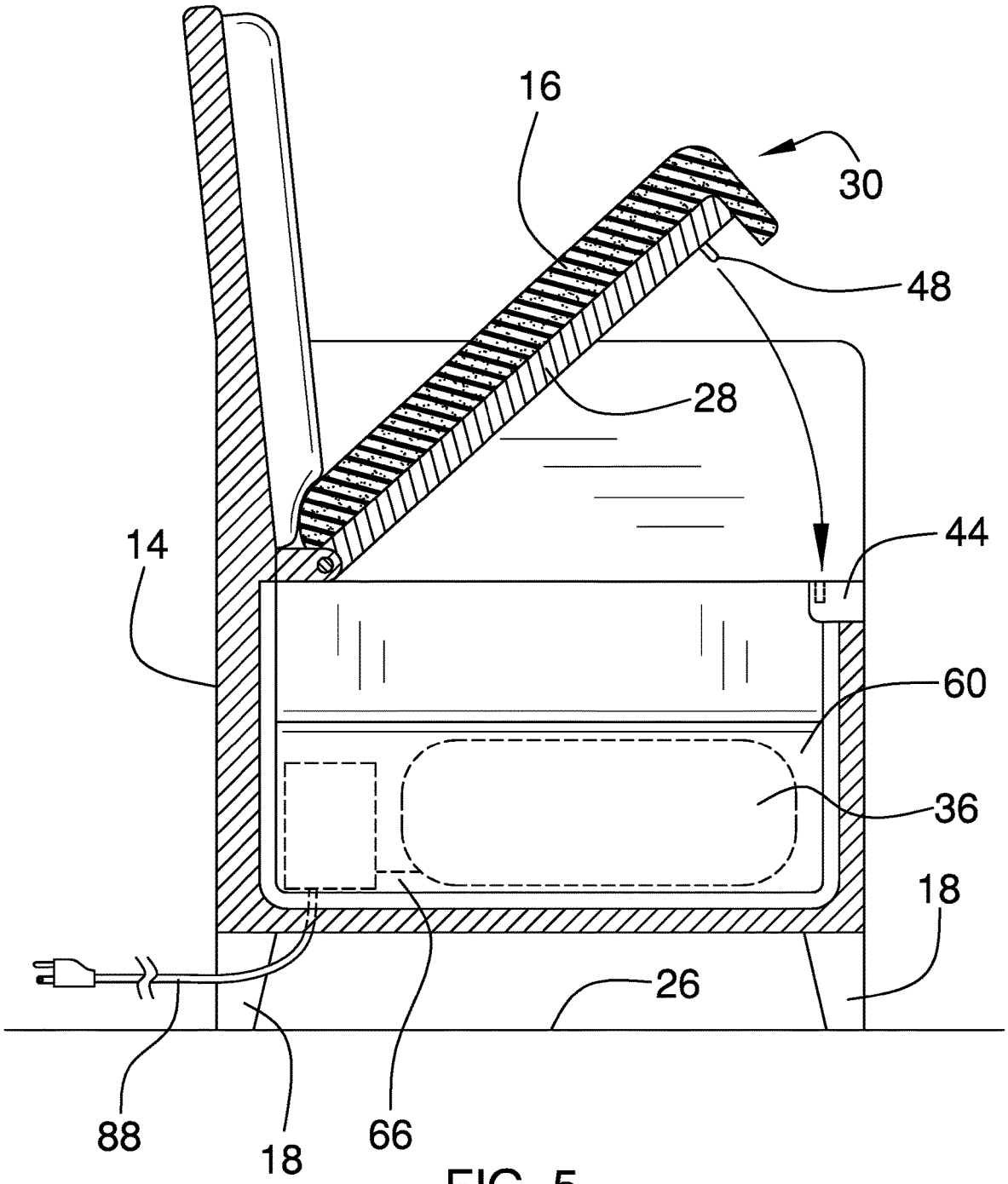
FIG. 5 is a cross-sectional view of an embodiment of the disclosure taken along line 5-5 of FIG. 2.
Figure 6:
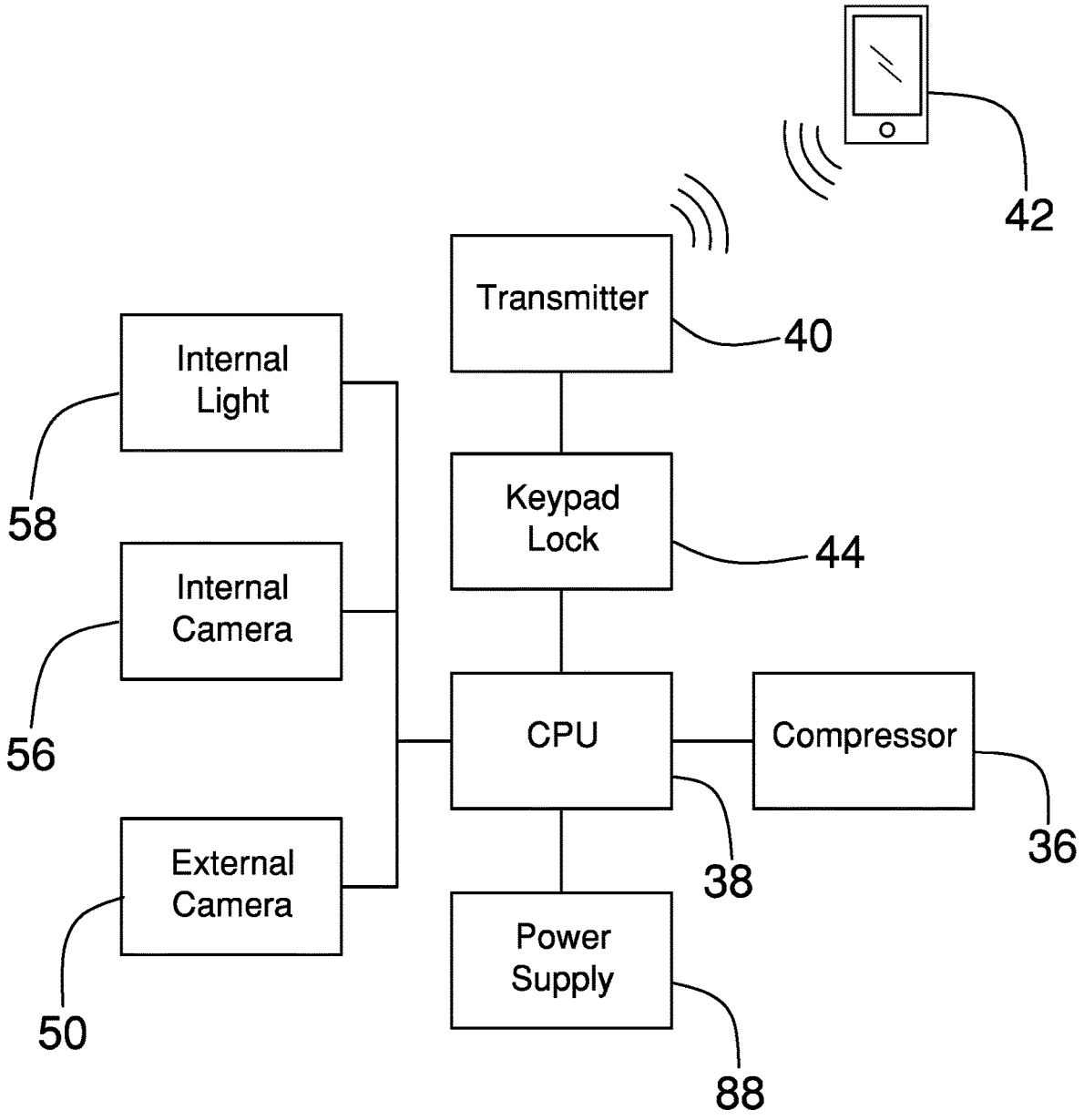
FIG. 6 is a schematic view of an embodiment of the disclosure.

With reference now to the drawings, and in particular to FIGS. 1 through 6 thereof, a new furniture and storage device embodying the principles and concepts of an embodiment of the disclosure and generally designated by the reference numeral 10 will be described.

As best illustrated in FIGS. 1 through 6, the refrigerated delivery receiving furniture system 10 generally comprises a piece of furniture 12 having a frame 14 and a seat 16 coupled to the frame 14. The piece of furniture 12 may have the conventional form of a couch, chair, or the like. The piece of furniture 12 further includes a plurality of legs 18. A container 20 is coupled to the piece of furniture 12. The frame 14 of the piece of furniture 12 generally extends around the container 20 or may be panels or sections attached to the container 20. Any exposed surfaces of the container 20 are styled, decorated, formed, or otherwise structured to have the general appearance of being part of the frame 14 of the furniture 12 such that the container 20 is not readily observed to be a device for storage or holding of items within. The container 20 has an interior space 22. The container 20 has an interior surface 24 encompassing the interior space 22. Each of the legs 18 is coupled to and extends from the frame 14 such that the plurality of legs 18 is configured to position the frame 14 and the container 20 in spaced relationship over a supporting surface 26.

A lid 28 is movably coupled to the container 20 to selectively cover the interior space 22. The lid 28 is movable between an open position 30 and a closed position 32. The lid 28 may be pivotally coupled to the container 20. A refrigeration assembly 34 is coupled to the container 20. The refrigeration assembly 34 includes a compressor 36 such that the refrigeration assembly 34 cools the interior space 22. Thus, the interior space 22 is suited for storage of items within the container 20 such as milk, eggs, or other items which may adversely influenced by heat. A processor 38 is coupled to the container 20 and operationally coupled to the compressor 36. A transceiver 40 is operationally coupled to the processor 38 wherein the refrigeration assembly 34 is configured for controlling operational settings of the compressor 36 through communications with an extrinsic device 42 such as a cellular phone, tablet, computer, or the like. Thus, the compressor 36 may be activated remotely so that the interior space 22 is only cooled when necessary to preserve stored items. To maximize efficiency a user may turn the compressor 36 on prior to or at delivery and then turn the compressor 36 off at a later time shortly before the container 20 can be emptied. The refrigeration assembly 34, processor 38 and all other electronics can be powered by a conventional power cord 88. The power cord 88 may be extended from a bottom of the furniture 12 adjacent to a back of the furniture 12 to assist in discrete placement of the power cord 88. This also allows for storage of the power cord 88 under the device such that view of the power cord 88 is effectively obscured when the power cord 88 is not in use.

A lock 44 may be provided to secure the lid in the closed position 32. The lock 44 is coupled to the container 20 and may utilize a key, sensor, or include a keypad 46. The lock 44 is disengaged to permit opening of the lid 28 when an authorized code is input using the keypad 46. The lock 44 is operationally coupled to the processor 36 wherein the lock 44 is configured to be controlled through communications with the extrinsic device 42. Locking and unlocking by way of the extrinsic device 42 may be an alternative to operation using the keypad 46. A locking flange 48 is coupled to and extends from the lid 28. The locking flange 48 is insertable into the lock 44 wherein the locking flange 48 is engaged by the lock 44 to secure the lid 28 in the closed position 32.

An exterior camera 50 is coupled to an outside of either one of the piece of furniture 12 and the container 20. The exterior camera 50 is positioned on a front face 52 adjacent to a corner 54 such that the appearance is easily dismissed as an opening or the like associated with construction as opposed to being a camera of any type. The exterior camera 50 is positioned for viewing images of an area adjacent to the piece of furniture 12. The exterior camera 50 is operationally coupled to the processor 36 wherein the exterior camera 50 is configured to deliver images captured by the exterior camera 50 to the extrinsic device 42. The exterior camera 50 may include motion sensing such that the exterior camera 50 is configured to deliver images to the extrinsic device 42 when motion is detected adjacent to the piece of furniture 12. Additionally, this may trigger an alert to the extrinsic device 42 if so desired. This may be to assist in monitoring when groceries are delivered or for security to determine possible theft or tampering with delivered groceries.

An interior camera 56 is coupled to the container 20 within the interior space 22 wherein the interior camera 56 is positioned for viewing images of the interior space 22. The interior camera 56 is operationally coupled to the processor 38 wherein the interior camera 56 is configured to deliver images captured by the interior camera 56 to the extrinsic device 42. The interior camera 56 includes an infrared capability of conventional design wherein the interior camera 56 is configured to captures images of the interior space 22 while the lid 28 is in the closed position 32 such that there is no light within the interior space 22. As an alternative to infrared capability, or in combination therewith, an interior light 58 may be coupled to the container 20 such that the interior light 58 selectively illuminates the interior space 22. The interior light 58 is illuminated when the lid 28 is not in the closed position 32. This may be achieved through use of a conventional physical switch (not shown) positioned to be contacted by the lid 28 when the lid 28 is in the closed position 32. Alternatively, or in combination therewith, the interior light 58 is operationally coupled to the processor 38 wherein the interior light 58 is configured to be controlled by the extrinsic device 42 or a programmed condition of the processor 38. This may include the processor 38 keeping the interior light 58 illuminated for a defined duration of time after closing of the lid 28, upon activation of the interior camera 56, upon opening of the lid 28, or upon another condition determinable by connection of the various components to the processor 38.

An interior wall 60 is positioned within the interior space 22 of the container 20. The interior wall 60 has a side section 62 and a top section 64. The top section 64 is perpendicularly oriented relative to the side section 62. The interior wall 60 defines a control chamber 66 within the container 20. Each of the refrigeration assembly 34, the processor 38 and the transceiver 40 is positioned in the control chamber 66. A vent 68 is coupled to the container 20 adjacent to the control chamber 66 wherein the vent 68 provides environmental communication through the container 20 to prevent overheating and to allow for exhaust to be expelled from the refrigeration assembly 34.

Each of a plurality of slots 70 extends into the interior surface 24. The slots 70 are vertically oriented and arranged into transversely aligned pairs 72 across the interior space 22. The plurality of slots 70 includes long slots 70A laterally spaced from the side section 62 of the interior wall 60 and extending fully from a bottom surface 72 of the interior space 22 to a top opening 74 of the interior space 22. The plurality of slots 70 includes short slots 70B. Each of the short slots 70B is positioned over the top section 64 of the interior wall 60. The short slots 70B include an aligned pair of short end slots 74 being coplanar with the side section 62. Generally, a panel 76 is provided to divide the interior space 22. The panel 76 may be a long panel 76A which has opposed ends 78 positionable within a selectable aligned pair of the long slots 70A wherein the long panel 76A divides the interior space 22 into compartments 80 within the container 20. The panel 76 may be a short panel 76B which has opposed edges 84 positionable within a selectable aligned pair of the short slots 70B wherein the short panel 76B divides the interior space 22 over the top section 64 of the interior wall 60. Multiple panels 76 may be provided to customize the arrangement of the interior space 22.

In use, the piece of furniture 12 is positioned outside a structure such as a dwelling like conventional outdoor or porch furniture. The lock 44 may remain unlocked until a delivery is made or may be unlocked either remotely through the extrinsic device 42 or by use of a one time preauthorized code to be given to a delivery person prior to or upon delivery. Upon delivery the compressor 36, if not previously activated, may be activated to keep items cold within the interior space 22 of the container 20. Time of delivery or confirmation of delivery can be determined by visual inspection using either or both of the exterior camera 50 and the interior camera 56. Communications through the extrinsic device 42 allow for granting access to the interior space 22 from a remote location if so desired. Access can also be obtained through use of the keypad 46.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A refrigerated delivery receiving furniture system comprising:

a piece of furniture having a frame and a seat coupled to said frame;

a container, said container being coupled to said piece of furniture, said container having an interior space, said container having an interior surface encompassing said interior space;

a lid, said lid being movably coupled to said container to selectively cover said interior space, said lid being movable between an open position and a closed position;

a refrigeration assembly coupled to said container, said refrigeration assembly including a compressor such that said refrigeration assembly cools said interior space;

a processor coupled to said container, said processor being operationally coupled to said compressor;

an interior camera coupled to said container within said interior space wherein said interior camera is positioned for viewing images of said interior space, said interior camera being operationally coupled to said processor wherein said interior camera is configured to deliver images captured by said interior camera to an extrinsic device;

a plurality of slots extending into said interior surface, each of said slots of said plurality of slots being vertically oriented, said plurality of slots being arranged into aligned pairs positioned opposite each other across said interior space; and a panel, said panel having opposed ends positionable within a selectable aligned pair of said slots wherein said panel divides said interior space into compartments within said container.

2. The system of claim 1, further comprising said lid being pivotally coupled to said container.

3. The system of claim 2, further comprising a lock, said lock securing said lid in said closed position.

4. The system of claim 3, further comprising:

a locking flange coupled to and extending from said lid;

said lock being coupled to said container, said locking flange being insertable into said lock wherein said locking flange is engaged by said lock to secure said lid in said closed position.

5. The system of claim 3, further comprising said lock including a keypad, said lock being disengaged to permit opening of said lid when an authorized code is input using said keypad.

6. The system of claim 1, further comprising a transceiver operationally coupled to said processor wherein said refrigeration assembly is configured for controlling operational settings of said compressor through communications with the extrinsic device.

7. The system of claim 6, further comprising:

said lid being pivotally coupled to said container;

a lock, said lock securing said lid in said closed position, said lock being operationally coupled to said processor wherein said lock is configured to be controlled through communications with the extrinsic device.

8. The system of claim 6, further comprising an exterior camera coupled to an outside of said piece of furniture, said exterior camera being positioned for viewing images of an area adjacent to said piece of furniture, said exterior camera being operationally coupled to said processor wherein said exterior camera is configured to deliver images captured by said exterior camera to the extrinsic device.

9. The system of claim 8, further comprising said exterior camera including motion sensing such that said exterior camera is configured to deliver images to the extrinsic device when motion is detected adjacent to the piece of furniture.

10. The system of claim 6, further comprising:

an interior wall positioned within said interior space of said container, said interior wall having a side section and a top section, said top section being perpendicularly oriented relative to said side section, said interior wall defining a control chamber within said container, said refrigeration assembly being positioned in said control chamber; and said processor and said transceiver being positioned within said control chamber.

11. The system of claim 1, further comprising said interior camera including an infrared capability wherein said interior camera is configured to captures images of said interior space while said lid is in said closed position.

12. The system of claim 1, further comprising an interior light coupled to said container such that said interior light selectively illuminates said interior space, said interior light being illuminated when said lid is not in said closed position.

13. The system of claim 12, further comprising said interior light being operationally coupled to said processor wherein said interior light is configured to be controlled by the extrinsic device.

14. The system of claim 1, further comprising said piece of furniture including a plurality of legs, each of said legs being coupled to and extending from said frame such that said plurality of legs is configured to position said frame and said container in spaced relationship over a supporting surface.

15. The system of claim 1, further comprising an interior wall positioned within said interior space of said container, said interior wall having a side section and a top section, said top section being perpendicularly oriented relative to said side section, said interior wall defining a control chamber within said container, said refrigeration assembly being positioned in said control chamber.

16. The system of claim 15, further comprising a vent coupled to said container adjacent to said control chamber wherein said vent provides environmental communication through said container.

17. A refrigerated delivery receiving furniture system comprising:

a piece of furniture having a frame and a seat coupled to said frame;

a container, said container being coupled to said piece of furniture, said container having an interior space;

a lid, said lid being movably coupled to said container to selectively cover said interior space, said lid being movable between an open position and a closed position;

a refrigeration assembly coupled to said container, said refrigeration assembly including a compressor such that said refrigeration assembly cools said interior space;

an interior wall positioned within said interior space of said container, said interior wall having a side section and a top section, said top section being perpendicularly oriented relative to said side section, said interior wall defining a control chamber within said container, said refrigeration assembly being positioned in said control chamber;

said container having an interior surface encompassing said interior space;

a plurality of slots extending into said interior surface, said slots being vertically oriented and arranged into transversely aligned pairs across said interior space, said plurality of slots including relatively longer slots laterally spaced from said side section of said interior wall and extending fully from a bottom surface of said interior space to a top opening of said interior space, said plurality of slots including relatively shorter slots, each of said relatively shorter slots being positioned over said top section of said interior wall, said relatively shorter slots including an aligned pair of short end slots being coplanar with said side section;

a relatively longer panel, said relatively longer panel having opposed ends positionable within a selectable aligned pair of said relatively longer slots wherein said relatively longer panel divides said interior space into compartments within said container; and a relatively shorter panel, said relatively shorter panel having opposed edges positionable within a selectable aligned pair of said relatively shorter slots wherein said relatively shorter panel divides said interior space over said top section of said interior wall.

18. A refrigerated delivery receiving furniture system comprising:

a piece of furniture having a frame and a seat coupled to said frame, said piece of furniture including a plurality of legs;

a container, said container being coupled to said piece of furniture, said container having an interior space, said container having an interior surface encompassing said interior space, each of said legs being coupled to and extending from said frame such that said plurality of legs is configured to position said frame and said container in spaced relationship over a supporting surface;

a lid, said lid being movably coupled to said container to selectively cover said interior space, said lid being movable between an open position and a closed position, said lid being pivotally coupled to said container;

a refrigeration assembly coupled to said container, said refrigeration assembly including a compressor such that said refrigeration assembly cools said interior space;

a processor coupled to said container, said processor being operationally coupled to said compressor;

a transceiver operationally coupled to said processor wherein said refrigeration assembly is configured for controlling operational settings of said compressor through communications with an extrinsic device;

a lock, said lock securing said lid in said closed position, said lock being coupled to said container, said lock including a keypad, said lock being disengaged to permit opening of said lid when an authorized code is input using said keypad, said lock being operationally coupled to said processor wherein said lock is configured to be controlled through communications with the extrinsic device;

a locking flange coupled to and extending from said lid, said locking flange being insertable into said lock wherein said locking flange is engaged by said lock to secure said lid in said closed position;

an exterior camera coupled to an outside of said piece of furniture, said exterior camera being positioned for viewing images of an area adjacent to said piece of furniture, said exterior camera being operationally coupled to said processor wherein said exterior camera is configured to deliver images captured by said exterior camera to the extrinsic device, said exterior camera including motion sensing such that said exterior camera is configured to deliver images to the extrinsic device when motion is detected adjacent to the piece of furniture;

an interior camera coupled to said container within said interior space wherein said interior camera is positioned for viewing images of said interior space, said interior camera being operationally coupled to said processor wherein said interior camera is configured to deliver images captured by said interior camera to the extrinsic device, said interior camera including an infrared capability wherein said interior camera is configured to captures images of said interior space while said lid is in said closed position;

an interior light coupled to said container such that said interior light selectively illuminates said interior space, said interior light being illuminated when said lid is not in said closed position, said interior light being operationally coupled to said processor wherein said interior light is configured to be controlled by the extrinsic device;

an interior wall positioned within said interior space of said container, said interior wall having a side section and a top section, said top section being perpendicularly oriented relative to said side section, said interior wall defining a control chamber within said container, each of said refrigeration assembly, said processor and said transceiver being positioned in said control chamber;

a vent coupled to said container adjacent to said control chamber wherein said vent provides environmental communication through said container;

a plurality of slots extending into said interior surface, said slots being vertically oriented and arranged into transversely aligned pairs across said interior space, said plurality of slots including relatively longer slots laterally spaced from said side section of said interior wall and extending fully from a bottom surface of said interior space to a top opening of said interior space, said plurality of slots including relatively shorter slots, each of said relatively shorter slots being positioned over said top section of said interior wall, said relatively shorter slots including an aligned pair of relatively shorter end slots being coplanar with said side section;

a relatively longer panel, said relatively longer panel having opposed ends positionable within a selectable aligned pair of said relatively longer slots wherein said panel divides said interior space into compartments within said container; and a relatively shorter panel, said relatively shorter panel having opposed edges positionable within a selectable aligned pair of said relatively shorter slots wherein said relatively shorter panel divides said interior space over said top section of said interior wall.

* * * * *